US005927113A

United States Patent [19]

Yu

[11] Patent Number: 5,927,113

[45] Date of Patent: Jul. 27, 1999

[54] COMBINATION LOCK WITH CODE PROTECTION DEVICE

[76] Inventor: Chun-Te Yu, P.O. Box 55-175, Taichung, Taiwan

[21] Appl. No.: 09/023,081

[22] Filed: Feb. 13, 1998

[51] Int. Cl.[6] ..... E05B 37/02

[52] U.S. Cl. ..... 70/312; 70/68; 70/316; 70/DIG. 44

[58] Field of Search ..... 70/67, 68, 312, 70/316, 317, 318, DIG. 21, DIG. 44, 70, 71, 69

[56] References Cited

U.S. PATENT DOCUMENTS

| | | | |
|---|---|---|---|
| 2,163,852 | 6/1939 | Pond | 70/317 |
| 3,597,945 | 8/1971 | Feinberg | 70/68 |
| 4,155,234 | 5/1979 | Bako | 70/316 |
| 4,742,700 | 5/1988 | Ling | 70/323 |
| 4,884,419 | 12/1989 | Ling | 70/68 |
| 5,136,864 | 8/1992 | Spiekermann et al. | 70/312 |
| 5,359,867 | 11/1994 | Ling et al. | 70/312 |
| 5,520,032 | 5/1996 | Ling | 70/DIG. 44 |
| 5,557,954 | 9/1996 | Ling | 70/68 |
| 5,560,232 | 10/1996 | Chen | 70/312 |
| 5,689,979 | 11/1997 | Yu | 70/68 |

*Primary Examiner*—Darnell M. Boucher
*Attorney, Agent, or Firm*—Harrison & Egbert

[57] ABSTRACT

A combination lock with code protection device is provided. The lock includes a casing mounted with conventional numeral dials, a pair of posts capable of mounting the tabs of a single double zipper fastener or a dual double zipper fastener, a rotatable switch covering the posts when the lock is in locked position and uncovering the posts when the lock is in unlocked position and a detent rotatably disposed into a circular hole for checking a slide for facilitating the changing of a new combination code for the lock. This disclosure is characterized in the protection of the combination code old or new from disturbed by unintentional rotation of the dials.

1 Claim, 9 Drawing Sheets

COMBINATION LOCK WITH CODE PROTECTION DEVICE

BACKGROUND OF THE INVENTION

The present invention relates to the combination locks and more particularly to a combination lock with code protection device suitable to lock the tabs of a double zipper fastener in a suitcase or a luggage which device includes a rotatable switch and a rotatable detent means for protecting the code of the combination lock from disturbed intentionally or unintentionally and facilitating the users to change the exist code for their desired code of combination.

Typical combination lock for locking the tabs of a double zipper fastener in a suitcase or a luggage include two, three or four dials. Each dial has been designated a numeral by the manufacturer to form a specific combination code for each of the individual combination lock. Because the combination code is unchangeable, once the user is supposedly forgot the designated combination code of his own suitcase or any one of the dials is unintentionally disturbed, he will never open his suitcase except destroying the lock. To solve the above discussed problems, a latest type of combination lock is provided in the market, which type includes a device for facilitating the users to change the old one for their desired combination code, once they forgot the old code of their own combination lock or under the condition that they want to change the code for the anti-burglar purpose. However, to change the code in this type of combination lock, the user has to hold the button with one hand and rotates the dials with the another. Since the dials are relatively small and their intervals are relatively limited, it is difficult to designate a numeral for each of the dials without disturbing the others. So that it may cause a situation when a new code is supposedly and correctly designated, but it is substantially wrong because of that the user is inadvertently disturbed the other dial which the numeral is previously designated.

The present invention is arisen to militate and/or obviate the afore-discussed disadvantages and provides a new combination lock which includes a code protection device and especially that the user can designate a new code with a single hand and does it concentratively.

SUMMARY OF THE INVENTION

The present invention has a main object to provide a combination lock with code protection device including a rotatable detent means which checks the slide of the combination lock from sliding so as to facilitate the user to change his old code for a new desired code concentratively with a single hand.

Another object of the present invention is to provide a combination lock with code protection device which lock includes a rotatable switch which protects the tabs from revealing to outside of the lock.

Further object of the present invention is to provide a combination lock with code protection device including a plurality of visual windows for which the dial can be less revealing to outside of the lock, therefore preventing the dials from unintentionally disturbed.

The present invention will become more fully understood by referent to the following detailed description thereof when read in conjunction with the attached drawings.

DETAILED DESCRIPTION OF THE PREFERRED EMBODIMENT

Figure 1:
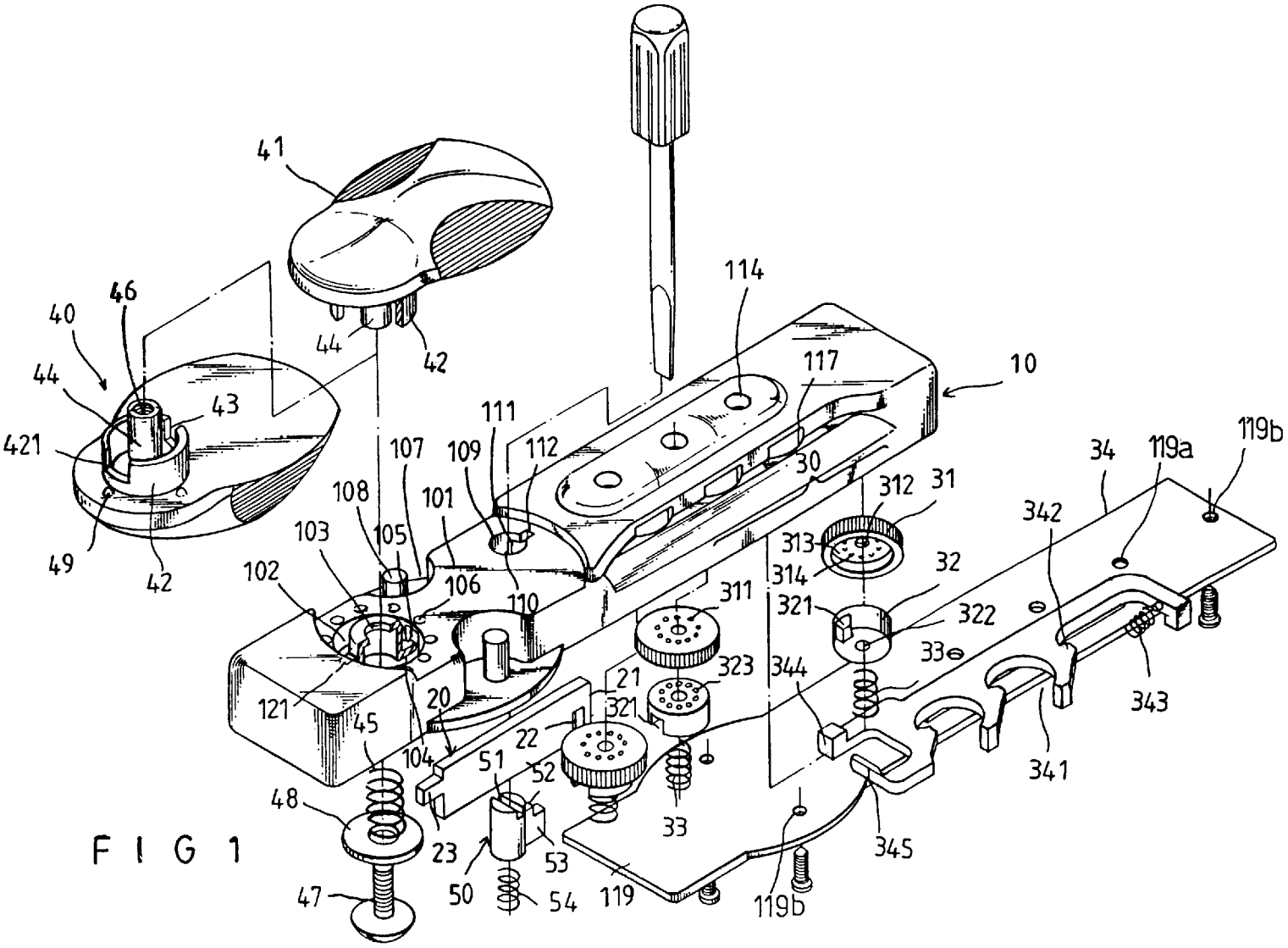
FIG. 1 is an exploded perspective view to show the preferred embodiment of the present invention.
Figure 2:
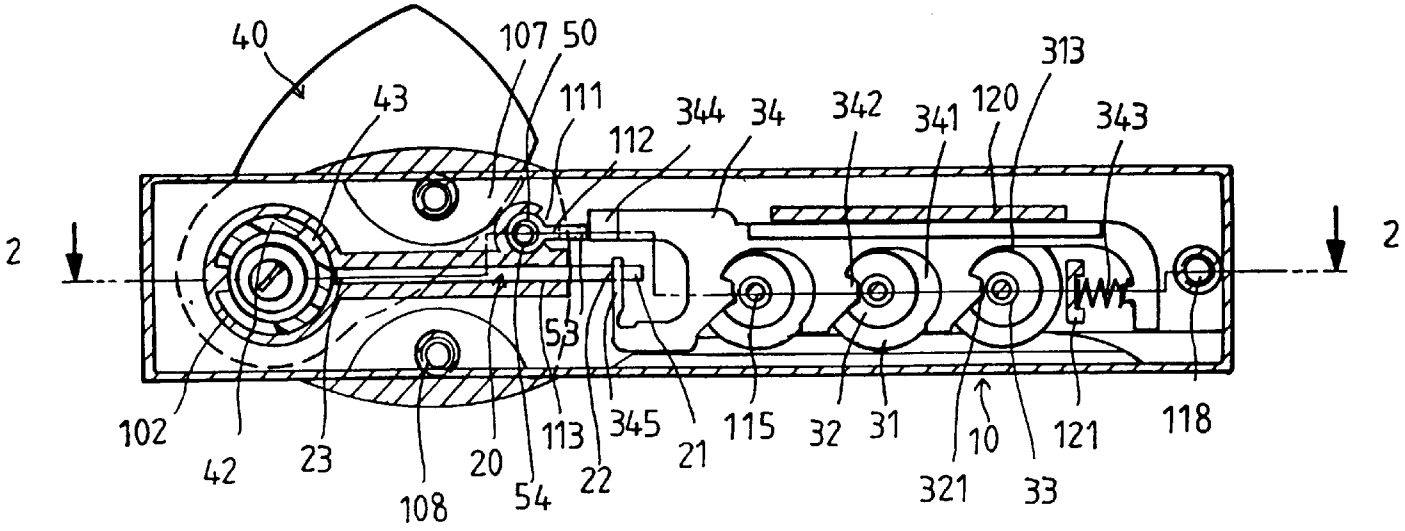
FIG. 2 is a top view with partially sectional view to show an assembled combination lock of FIG. 1.
Figure 3:
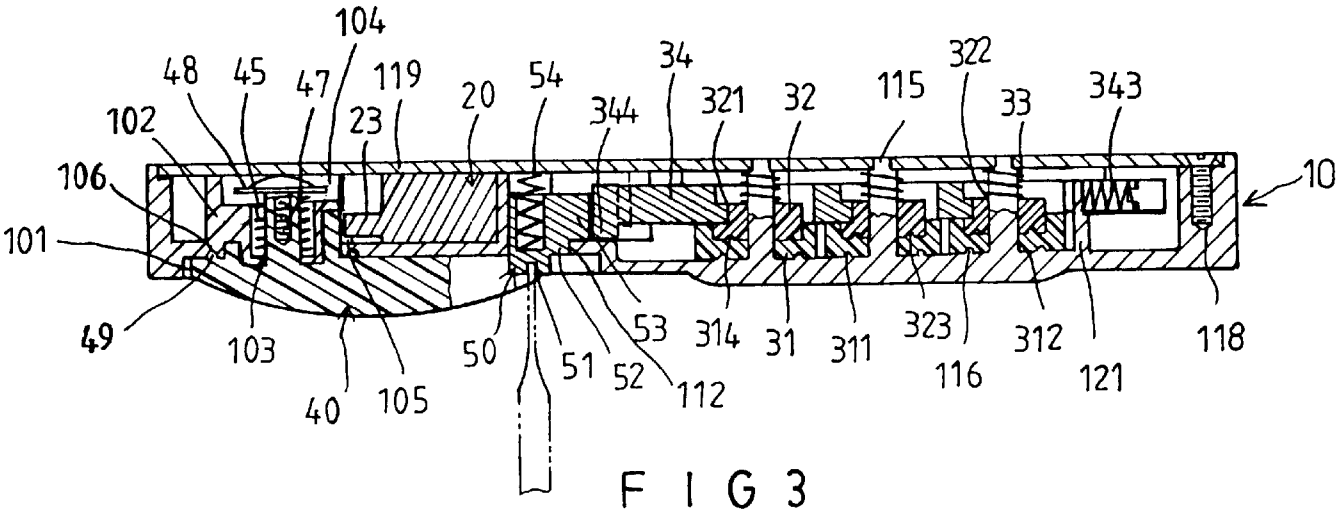
FIG. 3 is an elevational section of FIG. 2 where the lock is put upside down.

With reference to the drawings and initiating from FIGS. 1, 2 and 3, the combination lock with code protection device of the present invention comprises generally a rectangular casing 10, a latch member 20, a dial assembly 30, a rotatable switch 40 and a rotatable detent means 50.

The casing 10 which is adaptable to lock the tabs of single or dual double zipper fastener in a suitcase or a luggage includes a hollow rectangular body, a depression 101 in the top of the casing 10 in the proximity of one end thereof, a circular cavity 102 formed in one end of the depression 101, a hollow cylindrical pivot 103 centrally projected upward from the bottom of the cavity 102 so as to define an annular bearing area 104 between itself and the cavity 102, a rectangular aperture 105 through a circumferential wall of the cavity 102 and accessible to the interior of the casing 10, a plurality of dotted recesses 106 adjacent the circumferential edge of the cavity 102 therearound, an introrse hemispherical pit 107 formed in each of the lateral sides of the depression 101 in symmetry with each other and each of them having an outwardly expanding arcuate bottom on the center of which an internally threaded post 108 projects upward, a circular hole 109 positioned slightly biasing to a lateral side of the other end of the depression 101 opposite to the cavity 102 under which is a sleeve member 110, a positioning slot 112 abutting a circumferential edge of the hole 109 under which is an indenture 111 which is wider than the slot 112, a longitudinal guide 113 centrally formed inside the casing 10 under the depression 101 and communicating with the aperture 105, a plurality of visual windows 114 centrally formed spaced apart along the length of a longitudinal protrusion on the top biasing to one lateral side of the casing 10 which windows 114 are prepared to facilitate that the numerals of the dials would be visible from hereto, a plurality of poles 115 spacedly projected downward from an inner surface of the casing 10 adjacent the windows 114 (as shown in FIG. 2), a plurality of first dotted protrusions 116 formed spaced apart around each of the poles 115, a plurality of accesses 117 formed spaced apart through a vertical wall of an elongate pit in another lateral side of the casing 10 adjacent the windows 114 and a first screw hole 118 centrally formed at one end of the casing 10 for coupling the casing 10 with a rectangular lid 119 which has a flat rectangular body of a shaped conforming with that of the casing 10, a plurality of recesses 119*a* formed spaced apart for securing the ends of the poles 115 and a plurality of second screw holes 119*b* for coupling with the lid 119 to the holes 108 of the casing 10 by screws. Inside the casing 10, further includes a second longitudinal extension 120 and a transverse extension 121 (as shown in FIGS. 2 and 3).

The latch member 20 is slidably disposed into the longitudinal guide 113 but longer than the guide 113 and includes a flat rectangular body 21, a vertical slot 22 at a first end and a catch means 23 at a second end.

The dial assembly 30 is of a conventional type and includes a plurality of dial members rotatably disposed on the poles 115 respectively. The dial members each has numeral dial 31, a sleeve means 32 and a first tension spring 33. The numeral dial 31 includes a plurality of first spaced dotted recesses 311 around the upper surface and made in registry with the first dotted protrusions 116 of the casing 10, a first central bore 312, a chamber 313 in under side and a plurality of second spaced dotted protrusions 314 on the opposite side around the bore 312. The sleeve means 32 are engageable into the chambers 313 of the numeral dials 31 respectively and each includes a divergent notch 321 in a periphery, a second central bore 322 made in registry with bore 312 and a plurality of second spaced dotted recesses 323 on upper surface and made in registry with the second spaced dotted protrusions 311 of the numeral dials 31, when the dial members are disposed on the poles 115, a plurality of the first tension spring 33 will bias thereon prior to that the poles 115 insert into the recesses 119*a* of the lid 119. Since the user can watch the numeral dials 31 individually from the visual windows 114, the dials 31 may be positioned more inward relative to the conventional combination locks and reveal a little bit to outside of the casing 10, a slide 34 of a generally a flat rectangular body includes a plurality of sleeve holes 341 engageable with the sleeve means 32 and each having a coupling protrusion 342 engageable with the divergent notch 321, a second tension spring 343 biasing between an extension at a right end of the slide 34 and the transverse extension 121 of the casing 10, a vertical projection 344 and a flexible plate 345 at a left end thereof. The flexible plate 345 inserts into the vertical slot 22 of the latch means 20.

The rotatable switch 40 of a roughly beetle shaped body 41 includes an annular projection 42 centrally extended downward from an underside adjacent one end and rotatably engageable into the annular bearing area 104 having a first vertical slot 43 and a second vertical slot 421 in opposite vertical walls, the first vertical slot 43 is engageable with aperture 105 and the catch means 23, a hollow cylindrical axis 44 including threaded interior 46 projected downward from the center of the annular projection 42 and rotatably engageable into the hollow cylindrical pivot 103. When the switch 40 mounts to the casing 10, it is secured by a bolt 47 from inside of the casing 10 and biased with a third tension spring 45 and a washer 48, so that the switch 40 enables to slide vertically, either. The switch 40 further includes four small positioning protrusions 49 abutting four sides of the projection 42 engageable with the dotted recesses 106 of the casing 10.

Figure 7:
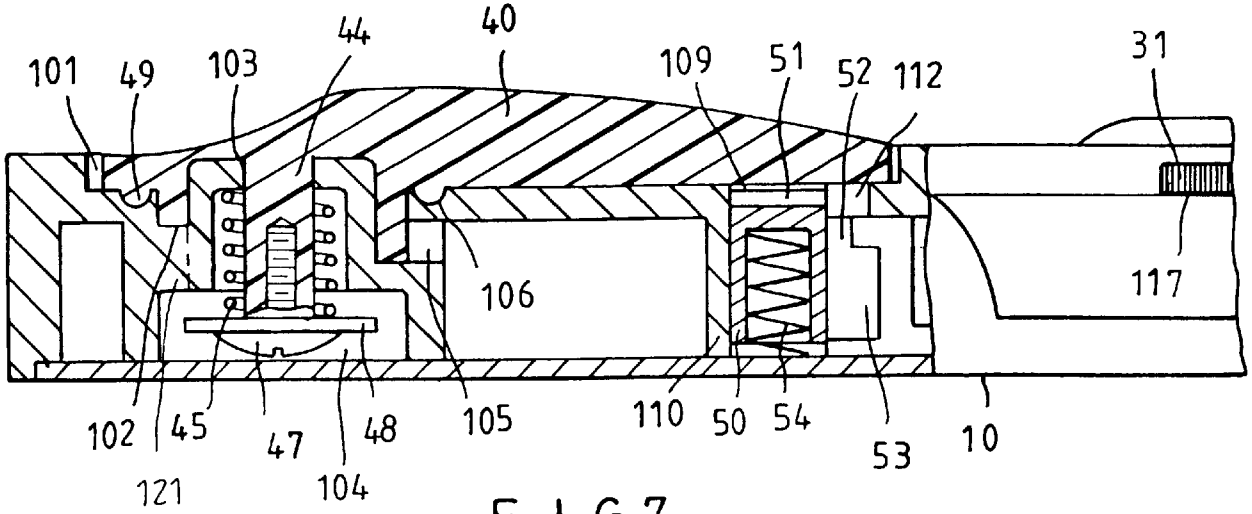
FIG. 7 is an elevational section of the left portion of the lock to show the rotatable switch engaged within a depression of the lock.
Figure 8:
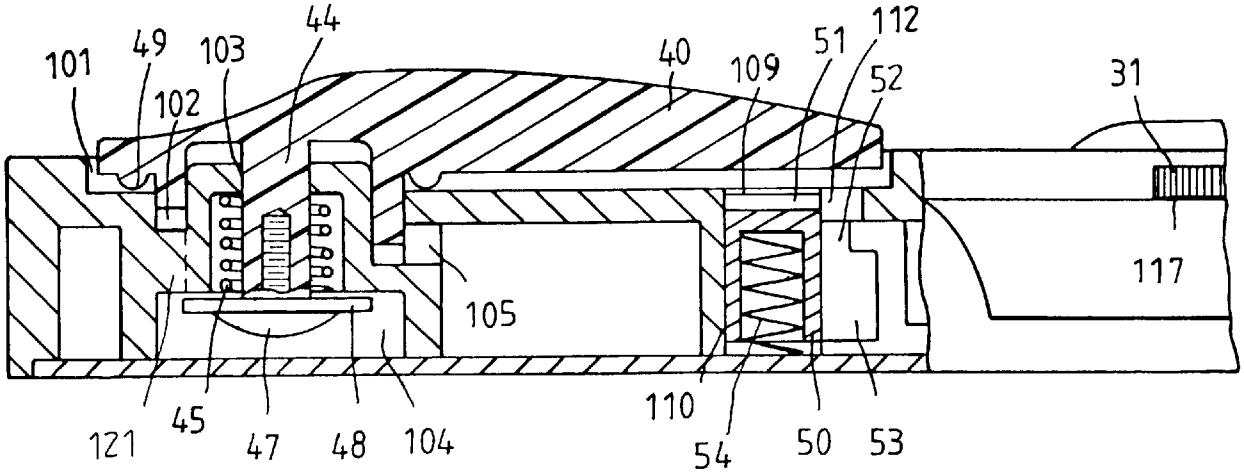
FIG. 8 is an elevational section of the left portion of the lock to show the rotatable switch disengaged within the depression of the lock.
Figure 9:
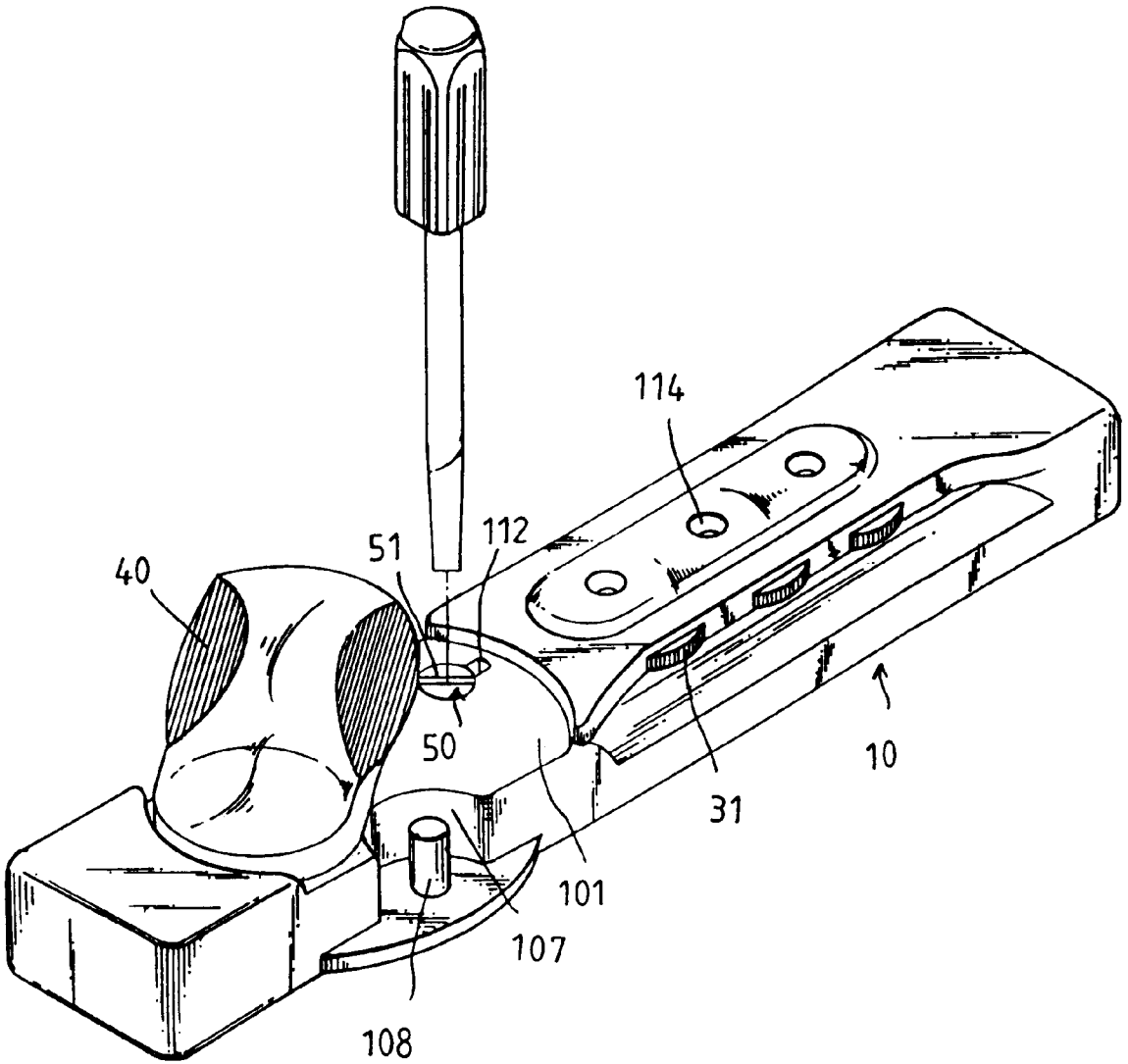
FIG. 9 is a perspective view of the lock indicating that a rotatable detent means is operable with a screwdriver.
Figure 10:
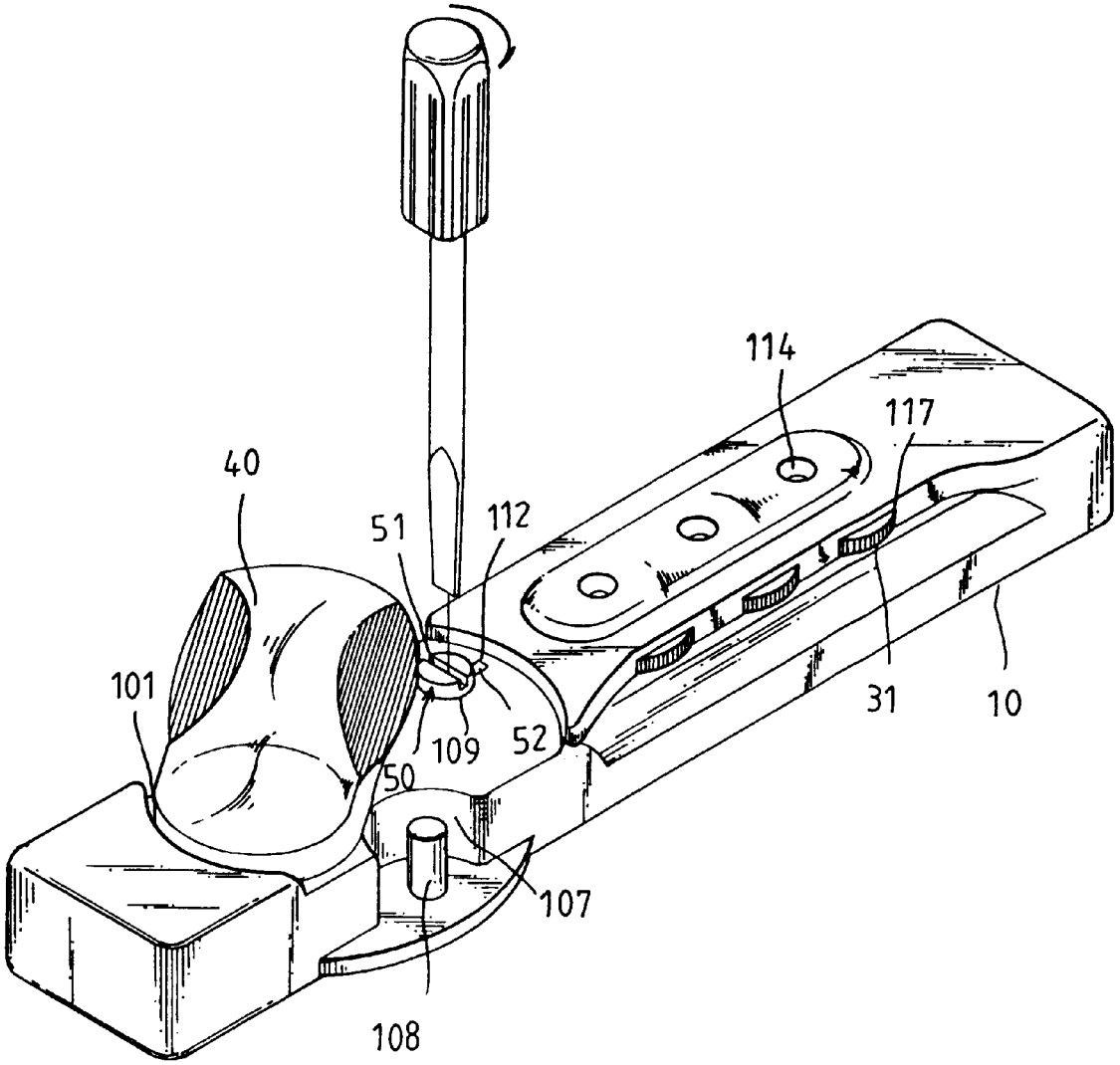
FIG. 10 is a perspective view indicating that the rotatable detent means is rotated clockwise by the screwdriver.
Figure 11:
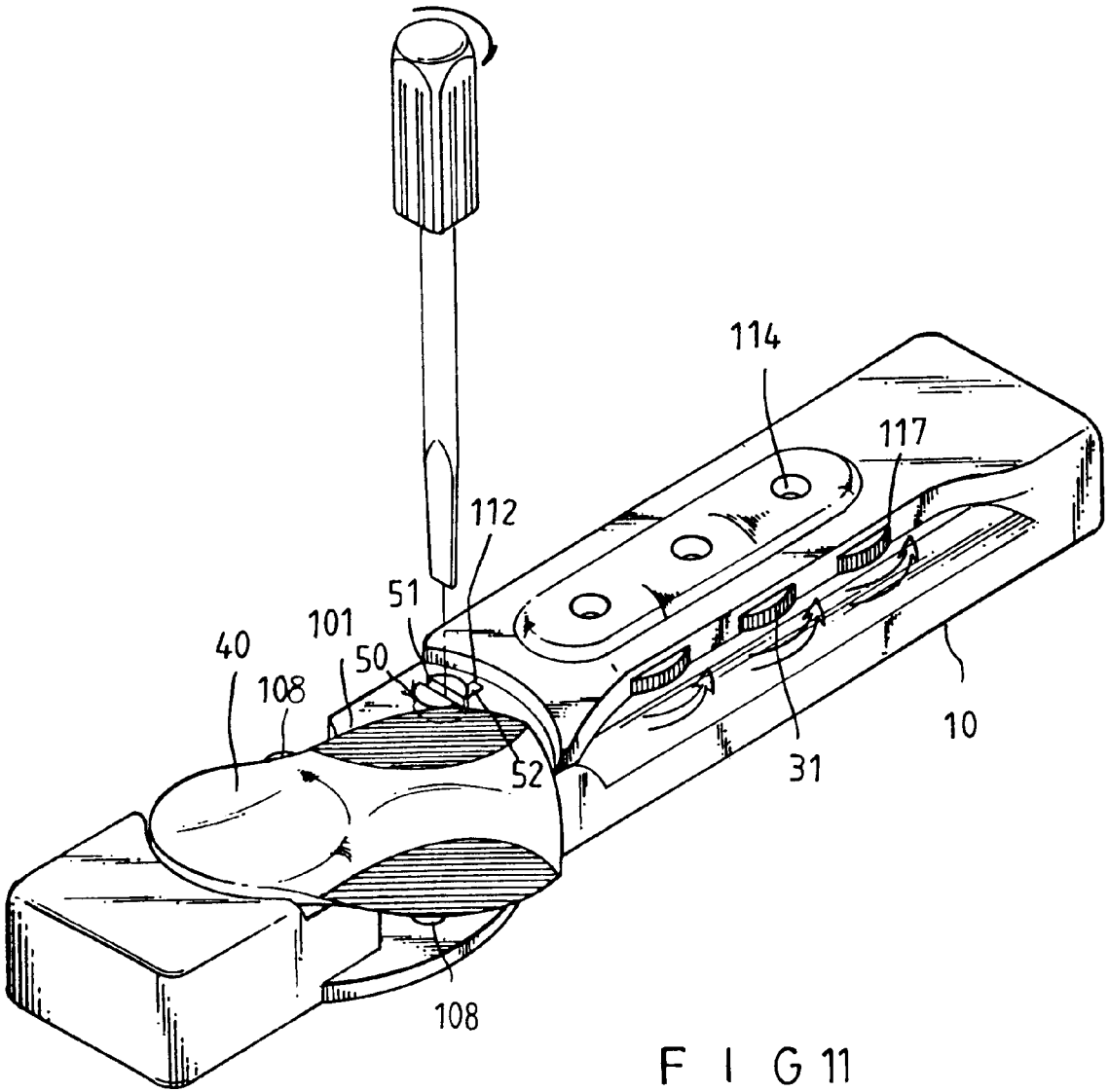
FIG. 11 is a perspective view indicating that the rotatable switch is rotated from one side to another where the dials are rotated, too.
Figure 12:
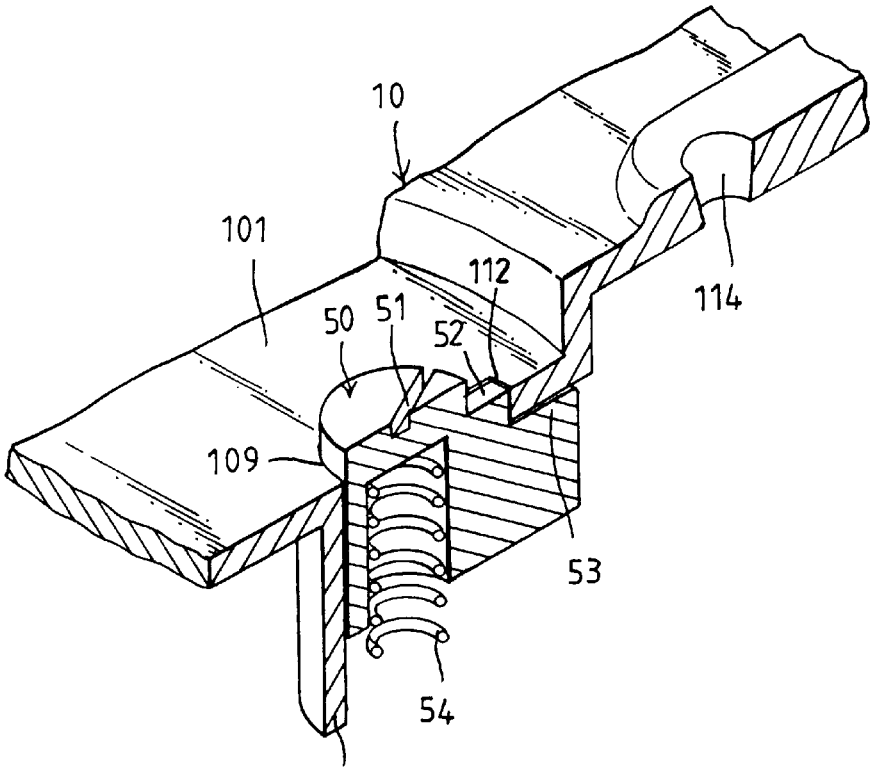
FIG. 12 is a perspective view with partially sectional view to show that the rotatable detent means is checked in a longitudinal slot of the lock.
Figure 13:
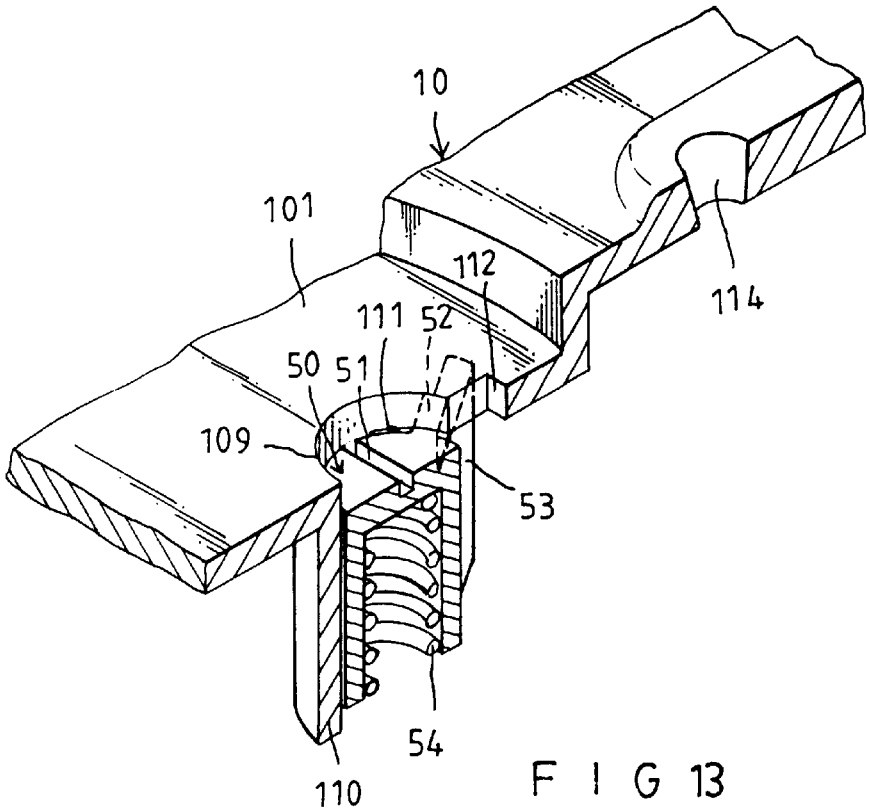
FIG. 13 is a perspective view with partially sectional view to show that the detent means is pressed downward and disengaged with the longitudinal slot.
Figure 14:
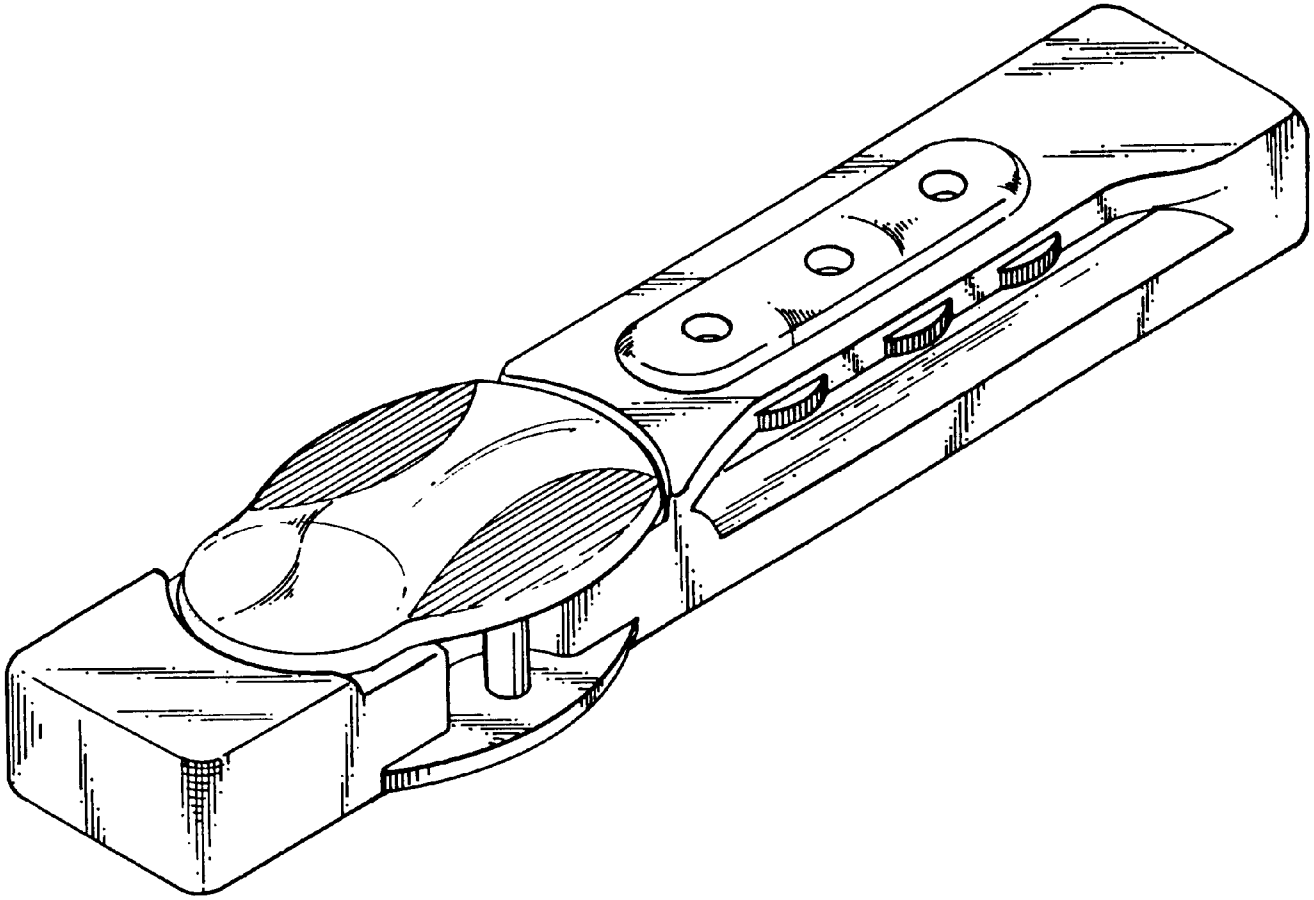
FIG. 14 is a perspective view to show the assembly of the present invention.

The rotatable detent means 50 of a hollow interior cylindrical body rotatably and slidably disposed into the circular hole 109 of the casing 10 secured by the large diameter sleeve member 110 and biased by a fourth tension spring 54, a radial slot 51 in the top, a check 52 integrated with a large sized block 53 extended outward from a periphery of the body. The block 53 is engageable with the vertical projection 344 of the slide 34 and the check 52 is engageable with the positioning slot 112. It is understood that the detent means 50 also can be vertically slidable and normally hides in the circular hole 109 protected by the rotatable switch 40. FIG. 2 shows an assembled combination lock of the present invention. When the rotatable switch 40 is at its closed position relative to the casing 10, its positioning protrusions 49 engage into two pairs of symmetrical dotted recesses 106 around the cavity 102 (as shown in FIG. 7). This arrangement ensures that the switch 40 will fitably rests in the depression 101 of the casing 10 without losing up.

Figure 4:
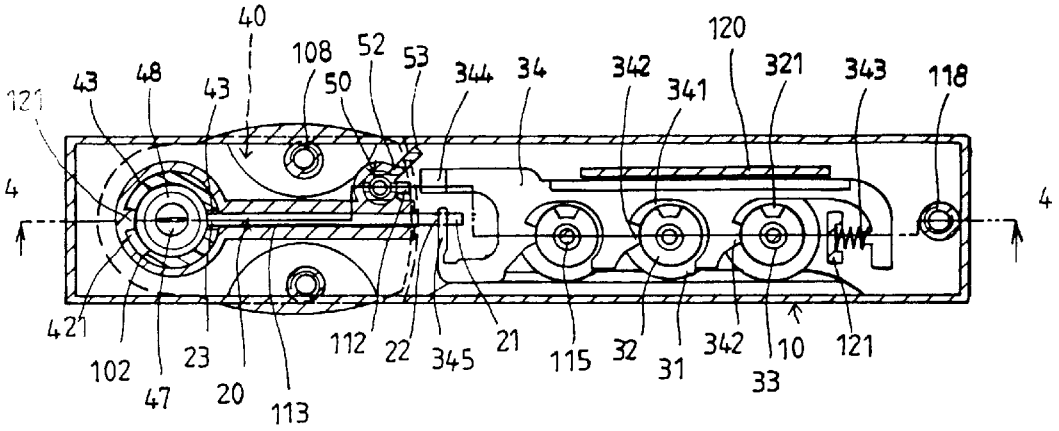
FIG. 4 is a top view with partially sectional view indicating that the dials are not on-combination where the lock is at locked position.
Figure 5:
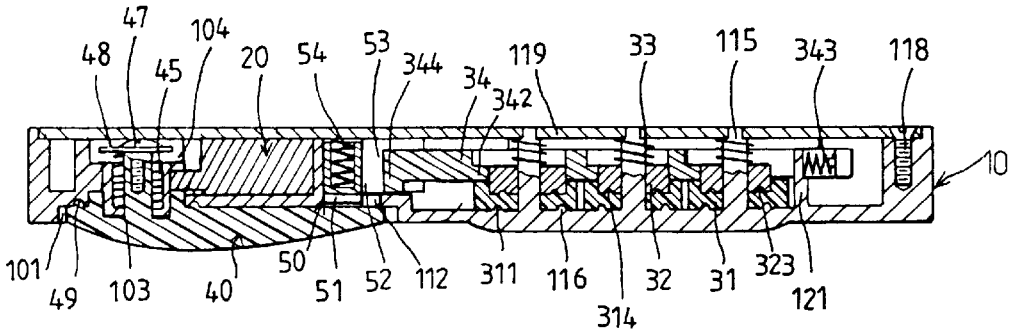
FIG. 5 is an elevational section taken from line 4—4 of FIG. 4 where the lock is put upside down.

In operation, when the lock is on combination as the coupling protrusions 342 of the slide 34 are all engaged into the divergent notches 321 of the sleeve means 32, the slide 34 trends to a rightward position because of the resilient force of the spring 343 and the latch means 20 is also moved rightward by the flexible plate 345. Since the catch means 23 is disengaged with the vertical slot 43, so that the switch 40 becomes rotatable to set free the posts for engaging or disengaging the tabs of the double zipper fastener thereon, therefore, the luggage becomes openable (as shown in FIGS. 2 and 3). Contrarily, if the coupling protrusions 342 are disengaged with the divergent notches 321 (as shown in FIGS. 4 and 5), the slide 34 should tend to a leftward position and the latch means 20 moves leftward and its catch means 23 engages into the vertical slot 43 so as to check the switch 40 from rotation, therefore, the lock is in a closed (locked) position.

Figure 6:
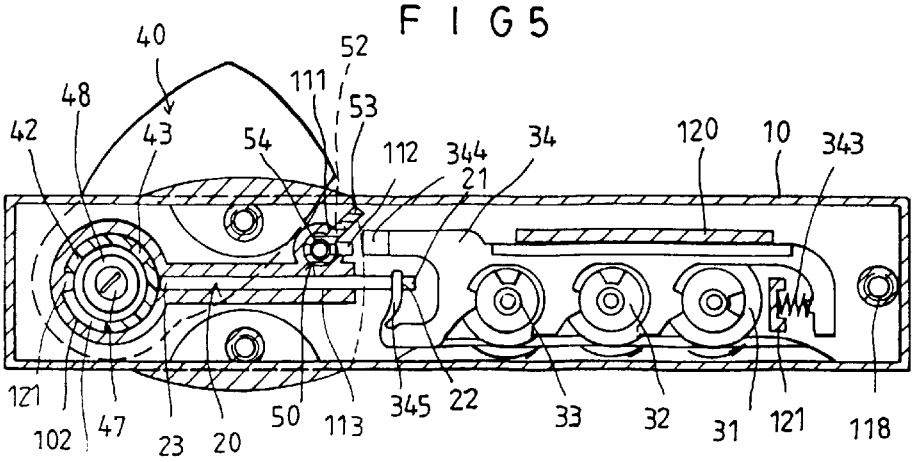
FIG. 6 is a top view with partially sectional view indicating that the rotatable switch is at an opening position and the dials are not on-combination so that the flexible plate is bent rightward.

FIG. 6 shows that the switch 40 rotates to a leftward position, its vertical slot 43 disengages with the slot 105 so as to block the catch means 23 from inserting through the slot 105. This time, if one rotates the dial members 30 to disorder the combination code, the slide 34 will also be moved leftward because the coupling protrusions 342 become stopped against a peripheral wall of the sleeve means 32 and because of the flexibility of the flexible plate 345, it permits the leftward movement of slide 34. Since the engagement of the protrusions 314 with the recesses 323 provide considerable frictions therebetween, this time, the sleeve means 32 are rotated in concert with their numeral dials 31. Therefore, the combination code is not changed. This arrangement protects the combination code of the lock from unintentionally disturbed.

Referring to FIGS. 9 to 13 and again FIGS. 2 and 3, if the user wants to change from an old code into a newly desired combination code, he may rotate the rotatable switch 40 clockwise or counterclockwise for revealing the detent means 50 to outside of the casing 10, and operate the detent means 50 with a suitable means such as a screwdriver which inserts into the radial slot 51 and turns the detent means 50 clockwise to engage its check 52 with the positioning slot 112 of the circular hole 109 so that the detent means 50 jumps upward for the resilient force of the spring 54, then the block 53 stops against the inner surface of the casing 10 and its forward end stops against the vertical projection 344 of the slide 34 so as to check the slide 34 from moving leftward relative to the casing 10. Since the dial assembly 30 is on combination and the sleeve means 32 are checked from rotation and because the elasticity of the springs 33, the numeral dials 31 enable to turn individually, this time, one can rotate the numeral dials 31 a little harder to offset the friction between the protrusion 314 and recesses 323, then seeks a different numeral for each of the numeral dial 31 without disturbing their sleeve means 32. So that the relative positions between the numeral dials 31 and the sleeve means 32 are changed and a new desired combination code is therefore sought. Then press the detent means 50 downward to disengage its check 52 with the vertical slot 112 and turn the detent means 50 counterclockwise to have the check 52 stopped against an inner surface of the casing 10 so as to enable the vertical projection 344 of the slide 34 to be moving leftward and then turn the rotatable switch 40 back to its closed position. Therefore, the process of changing a combination code is accomplished.

It is understood that the arrangement of the positioning protrusions 49 and the spring 45 for the rotatable switch 40 in coperation with the dotted recesses 106 around the cavity 102 enables the switch 40 stopped stably at any angle relative to the longitudinal line of the casing 10. The detent means 50 is normally covered by the rotatable switch 40. One can't open the switch 40 without known the combination code. So it gives no chance for a strenger to make code changing. When the detent means 50 jumps upward, it is stabilized by the block 53 so as to facilitate the user to change the combination code concentratedly with a single hand. Further, the upward detent means 50 makes an obstruction to prevent the rotatable switch 40 from turning back to its closed position, so that the lock is not operable unless the user turns the detent means 50 back to normal position. This would obviate the disturbance of the combination code either new or old. Because of the flexible plate 345 of the slide 34, an unintentional rotation of the dials will not disturb the combination code.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A combination lock with code protection device comprising:

a casing of a hollow rectangular body including a depression having lateral sides and opposite ends in a top in the proximity of one end of the casing, a circular cavity adjacent one end of the depression having a hollow cylindrical pivot centrally projected upward from a bottom thereof so as to define an annular bearing area, a rectangular aperture through a circumferential wall of the cavity therearound, an introrse hemispherical pit in each of the lateral sides of the depression made in a symmetrical manner and each of them having an outwardly expanding arcuate bottom on the center of which an internally threaded post projects upward, a circular hole positioned to a lateral side of the other end of the depression opposite to the cavity; said hole having a circumferential edge, a positioning slot and a widened indenture under the slot; a longitudinal guide centrally extending along an inner surface of the casing under the depression and communicating with the aperture, a plurality of visual windows extending spaced apart along the length of a longitudinal protrusion on the top of the casing, a plurality of poles spacedly projected downward from the inner surface of the casing adjacent the windows, a plurality of first dotted protrusions formed spaced apart around each of the poles, a plurality of accesses formed spaced apart through a vertical wall of an elongate pit in one of the lateral sides of the casing adjacent the windows, a longitudinal extension and a transverse extension extending on the inner surface of the casing at the end opposite to the longitudinal extension, and a first and a pair of second screw holes formed spaced apart around the edges of the casing for coupling the casing with a rectangular lid which has a flat rectangular body of a shape conforming with that of the casing, a plurality of recesses on the lid formed spaced apart for securing the ends of the poles from the casing;

a latch member of a flat rectangular body slidably disposed into the longitudinal guide of a casing and having the length longer than the guide and including a vertical slot at a first end and a each means at a second end thereof;

a dial assembly including a plurality of dial members rotatably disposed on the poles respectively and each having a numeral dial engaged with a sleeve and biased by a first spring means and visible from the windows and accessible from the accesses of the casing; said numeral dial each including a plurality of first spaced dotted recesses around an upper surface engageable with the first dotted protrusions of the casing, a first central bore, a chamber in an under side having a plurality of second dotted protrusions on the under side around the first central bore; each said sleeve including a divergent notch in a periphery, a second central bore made in registry with the first central bore and a plurality of second spaced dotted recesses on an upper surface made in registry with the second dotted protrusions of the numeral dial;

a slide including a plurality of sleeve holes engageable with the sleeves and each sleeve hole having a coupling protrusion engageable with the divergent notch, a second spring means biasing between an extension of the slide at a first end and the transverse extension of the casing and a vertical projection and a flexible plate at a second end of the side wherein said flexible plate is inserted into the vertical slot of the latch member;

a rotatable switch including an annular projection centrally extending vertically downward from an underside adjacent one end thereof and rotatably engageable into the annular bearing area, said annular projection having a first vertical slot in a vertical wall which is engageable with the rectangular aperture of the cavity and the catch means, a second vertical slot in the vertical wall opposite to the first vertical slot, a hollow cylindrical axis of threaded interior projected downward from the center of the annular projection rotatably engaged into the hollow cylindrical pivot of the cavity and secured by a bolt and said switch being biased with a third spring means and a washer mounted on the axis between the bolt and the switch; two pair of positioning protrusions symmetrically formed on the underside of the switch for abutting dotted recesses in the depression of the casing;

a rotatable detent means comprising a hollow interior cylindrical body rotatably and slidably disposed into the circular hole of the casing, secured by a large diameter sleeve member from the under side of the hole, and biased by a fourth spring means, said body including a radial slot in the top and a check integrated with a block means extended outward from a periphery thereof wherein said block means is engageable with the vertical projection of the slide and said check is engageable with the positioning slot of the casing.

* * * * *